US009562435B2

(12) United States Patent
Merz

(10) Patent No.: US 9,562,435 B2
(45) Date of Patent: Feb. 7, 2017

(54) CELLULAR WHEEL, IN PARTICULAR FOR A PRESSURE WAVE SUPERCHARGER

(71) Applicant: MEC Lasertec AG, Leimbach (CH)

(72) Inventor: Karl Merz, Reinach (CH)

(73) Assignee: MEC Lasertec AG, Leimbach (CH)

( * ) Notice: Subject to any disclaimer, the term of this patent is extended or adjusted under 35 U.S.C. 154(b) by 892 days.

(21) Appl. No.: 13/903,586

(22) Filed: May 28, 2013

(65) Prior Publication Data

US 2013/0330200 A1 Dec. 12, 2013

(30) Foreign Application Priority Data

Jun. 7, 2012 (EP) ..... 12171157

(51) Int. Cl.
*F01D 5/00* (2006.01)
*F02B 33/42* (2006.01)
*F04F 13/00* (2009.01)

(52) U.S. Cl.
CPC ..... *F01D 5/00* (2013.01); *F02B 33/42* (2013.01); *F04F 13/00* (2013.01)

(58) Field of Classification Search
CPC ..... F01D 5/00; F01D 5/005; F01D 5/02; F01D 5/022; F01D 5/027; F04F 13/00; F02B 33/42
See application file for complete search history.

(56) References Cited

U.S. PATENT DOCUMENTS 2,399,394 A * 4/1946 Seippel ..... F02B 33/42 122/4 R
2,526,618 A * 10/1950 Darrieus ..... F04F 13/00 116/DIG. 22
2,675,173 A * 4/1954 Jendrasski ..... F04F 13/00 417/225
3,109,580 A * 11/1963 Kentfield ..... F02B 33/42 417/64
3,545,882 A 12/1970 Williamson
(Continued)

FOREIGN PATENT DOCUMENTS

EP 2 253 853 A1 11/2010
EP 2 450 121 A1 5/2012
(Continued)

OTHER PUBLICATIONS

European Search Report for EP 12 17 1157 dated Sep. 20, 2012.

*Primary Examiner* — Ninh H Nguyen
*Assistant Examiner* — Wayne A Lambert
(74) *Attorney, Agent, or Firm* — Sughrue Mion, PLLC

(57) ABSTRACT

A metal cellular wheel (10) for a pressure wave supercharger comprising an outer sleeve (12) arranged coaxial to a rotational axis (y), an inner sleeve (14) arranged coaxial to the outer sleeve (12), and at least one intermediate sleeve (18) arranged between and coaxial to the outer sleeve (12) and the inner sleeve (14). Fins (16) are arranged between successive sleeves (12, 18; 18, 14), aligned radially to axis (y), and joined to adjacent sleeves (12, 18; 18, 14). On outer sleeve (12), outer sealing sleeves (24) engage over the outer sleeve (12), are joined with the outer sleeve (12), and have a sealing profile (30) for a labyrinth seal. A drive shaft (13) along axis (y) is joined with the inner sleeve (14), and the intermediate sleeve(s) (18) has (have) notches (26) extending, between adjacent fins (16), from both end faces (11) of the cellular wheel (10).

38 Claims, 8 Drawing Sheets

(56) References Cited

U.S. PATENT DOCUMENTS

| | | | | | |
|---|---|---|---|---|---|
| 4,288,203 | A * | 9/1981 | Fried | F04F 13/00 | 417/64 |
| 4,529,360 | A * | 7/1985 | Kirchhofer | F02B 33/42 | 417/64 |
| 4,887,942 | A * | 12/1989 | Hauge | F15B 3/00 | 417/64 |
| 4,929,119 | A * | 5/1990 | Vinciguerra | F16D 1/097 | 403/277 |
| 5,292,385 | A * | 3/1994 | Kington | F01D 5/02 | 148/404 |
| 5,988,993 | A * | 11/1999 | Hauge | F04F 13/00 | 417/365 |
| 6,210,108 | B1 * | 4/2001 | Ebacher | B23P 6/002 | 228/119 |
| 6,460,342 | B1 * | 10/2002 | Nalim | F02C 3/02 | 60/39.45 |
| 2011/0239463 | A1 * | 10/2011 | Merz | B21C 37/22 | 29/894 |

FOREIGN PATENT DOCUMENTS

| | | | | | |
|---|---|---|---|---|---|
| FR | 44585 | E * | 3/1935 | F04F 13/00 | |
| GB | 868101 | A * | 5/1961 | F04F 13/00 | |
| GB | 920624 | A * | 3/1963 | F04F 13/00 | |
| GB | 1 004 212 | A | 9/1965 | | |
| JP | EP 0095540 | A2 * | 12/1983 | F01D 5/027 | |
| WO | 2010/057319 | A1 | 5/2010 | | |

* cited by examiner 72
74
68

72
77
68
73

72
73
68
74
75

CELLULAR WHEEL, IN PARTICULAR FOR A PRESSURE WAVE SUPERCHARGER

TECHNICAL FIELD

The present invention relates to a cellular wheel made of metal, comprising an outer sleeve arranged coaxial to a rotational axis, an inner sleeve arranged coaxial to the outer sleeve, at least one intermediate sleeve arranged between and coaxial to the outer sleeve and the inner sleeve, fins that are arranged between successive sleeves and are aligned radially with regard to the rotational axis and joined with adjacent sleeves, further comprising outer sealing sleeves that engage over the outer sleeve and are joined with the outer sleeve and have a sealing profile for a labyrinth seal, and a drive shaft that lies in the rotational axis.

PRIOR ART

For some years, the method of downsizing has been one of the main topics in the design of new supercharged engines. With downsizing, fuel consumption and thus exhaust emissions of a vehicle can be reduced. Nowadays, these goals become increasingly important since high energy consumption through fossil fuels significantly contributes to air pollution, and increasingly strict legislative measures force the automobile manufacturers to take action. Downsizing is to be understood as the substitution of a high-volume engine by a reduced-capacity engine. At the same time, the engine power shall be maintained at a high level by charging the engine. The aim is to achieve with low-volume engines the same output values as with high-volume engines and equally powerful naturally aspirated engines. New findings in the field of downsizing have shown that in particular with very small Otto engines with a cubic capacity of 2 liters or less, the best results can be achieved with pressure wave supercharging.

In a pressure wave supercharger, the rotor is configured as a cellular wheel and is enclosed by air and exhaust gas housings having a common casing. The development of modern pressure wave superchargers for supercharging small engines leads to cellular wheels having a diameter in the order of 100 mm or less. In order to achieve a maximum cell volume and also a reduced weight, cell wall thicknesses of 0.4 mm or less are aimed for. Given the high exhaust inlet temperatures of around 1000° C., virtually only high-temperature resistant alloys can be considered as materials for the cellular wheel. Today, producing dimensionally stable and high-precision cellular wheels is still hardly possible, or is associated with considerable additional costs.

It has already been proposed to form the chambers of a cellular wheel from aligned and partially overlapping Z-shaped profiles. However, the production of such a cellular wheel is associated with high expenditure of time. Added to this is the fact that aligning and accurately positioning of Z-profiles with a precision sufficient to meet the required tolerances is hardly feasible.

Also, it has already been proposed to produce a cellular wheel from a solid body by eroding the individual cells. However, with this method it is hardly possible to achieve cell wall thicknesses of less than 0.5 mm. A further essential disadvantage of the erosion method is the high material and machining costs associated therewith.

A cellular wheel of the aforementioned type is disclosed in WO 2010/057319 A1. Trial runs under operating conditions have shown that the temperature changes with temperature differences of 200 to 300° C. occurring in rapid succession inside the cellular wheel in the region of the end faces result in periodically and significantly fluctuating thermal expansions and contractions of the fins in the radial direction. As a result, the fins arranged between successive sleeves and joined with said sleeves are exposed to high load changes with an oscillation frequency in the order of twice the speed of the cellular wheel, which, under permanent thermal load, can result in crack formation near the joints between fins and sleeves at the end faces of the cellular wheel and consequently in breakouts of fin parts and failure of the cellular wheel.

REPRESENTATION OF THE INVENTION

It is an object of the invention to produce a cellular wheel in a simple and cost-effective manner with the required precision while avoiding crack formation in the joint region between fins and sleeves. A further aim of the invention is to provide a cellular wheel suitable for use in a pressure wave supercharger for supercharging internal combustion engines, in particular for supercharging small Otto engines with a cubic capacity in the order of 2 liters or less. In particular, it shall be possible to produce cellular wheels with a cell wall thickness of 0.5 mm or less which are mechanically stable under operating conditions and have no tendency to crack formation in the joint region between fins and sleeves.

The solution according to the invention to the object is achieved in that at least the outer sleeve, the inner sleeve and/or the intermediate sleeve, or, in the case of more than one intermediate sleeve, at least one of the intermediate sleeves has notches extending, between adjacent fins, from both end faces of the cellular wheel. The notches are preferably rotationally symmetric.

The solution according to the invention to the object is also achieved in that solely the at least one intermediate sleeve has notches extending from both end faces of the cellular wheel. Accordingly, here, the outer sleeve and the inner sleeve are formed without notches. Preferably, to the left and to the right of a fin, there is in each case one notch or, respectively, there is preferably always one notch between two adjacent fins. The notches arranged in the intermediate sleeve thus provide for the respective fin an edge strip which is formed elastically movable with regard to the intermediate sleeve and to other edge strips, and which advantageously compensates the deformation of the fins caused by temperature fluctuation by means of a movement of the edge strip in a substantially radial direction. Thereby, the alternating bending stresses in the fin are largely reduced. The edge strips can also be designated as straps.

Preferably, two adjacent notches form an edge strip that belongs to the respective sleeve, wherein a single edge strip is assigned in each case a single fin. Such an edge strip is elastically movable relative to the respective sleeve and to the adjacent edge strips.

The notches are substantially distributed over the circumference of the respective sleeve in a preferably uniform manner. Another distribution depending on the arrangement of the fins is also conceivable.

Preferably, there are notches between all adjacent fins. However, it is also possible to provide fewer notches over the circumference of the sleeve. For example, a notch can be provided after every second or third fin.

Through the notches arranged between the joints of adjacent fins with the outer, inner and/or intermediate sleeve, the respective sleeve is divided in the edge region of the cellular wheel into edge strips so that adjacent edge strips are displaceable relative to each other in the radial direction. As a result, the fins together with the edge strips joined with the fins can expand and contract from their initial position in the sleeve in the radial direction so that the thermal expansions and contractions of the fins occurring in rapid succession in the radial direction result in a smaller stress build-up and stress relief through rapid alternating loads in the fins in the region of their joints with the outer, inner and/or intermediate sleeves, and damage to material can be avoided with this measure.

In order to avoid stress peaks at the ends of the notches and a formation and further propagation of a crack associated therewith, a recess as a so-called crack arrester can be provided at the ends of the notches. In plan view perpendicular to the centre axis, the recess can have a round or elliptical cross-section. The dimension of the recess preferably lies in the range of 1 to 2 mm.

In a first embodiment of the cellular wheel according to the invention, the inner sleeve is located on a flange sleeve that is arranged coaxial to the inner sleeve and is joined with the drive shaft, and the outer sleeve has notches extending, between adjacent fins, from both end faces of the cellular wheel. A marginal edge of the sealing sleeve, which marginal edge is located remote from the end faces of the cellular wheel, protrudes the notches by a certain amount, and the outer sealing sleeves are joined with the outer sleeve only in the region that protrudes the notches.

Preferably, the sealing profile of the outer sealing sleeves has a sealing surface that is aligned with the end faces of the cellular wheel, and the outer sealing sleeves form with the outer sleeve an annular gap that is open at the end faces of the cellular wheel.

Preferably, in this first embodiment, the inner sleeve also has notches that extend, between adjacent fins, from both end faces of the cellular wheel. Here, the inner sleeve is joined, between adjacent fins between notches located opposite each other, with the flange sleeve.

In a second preferred embodiment of the cellular wheel according to the invention, the inner sleeve is joined with the drive shaft, and the intermediate sleeve, or in the case of two or more intermediate sleeves, at least one of the intermediate sleeves has recesses that extend, between adjacent fins, from both end faces of the cellular wheel.

In this second embodiment, preferably, the sealing profile of the outer sealing sleeve has a sealing surface that is aligned with the end faces of the cellular wheel, and in the inner sleeve, inner sealing sleeves are arranged which are joined with the inner sleeve and which have a sealing profile with a sealing surface that is aligned with the end faces of the cellular wheel so as to form a labyrinth seal.

Preferably, in the second embodiment too, the sealing sleeves are joined with the outer and/or inner sleeves only in the region located remote from the end faces of the cellular wheel and form with the outer and/or inner sleeves an annular gap that is open at the end faces of the cellular wheel.

The sealing surface of the sealing profile and the annular gap that adjoins the sealing surface and is located between the sealing sleeve and/or the outer and/or inner sleeve are decisive for the tightness of a labyrinth seal between the end faces of the cellular wheel and the control surfaces of the gas and air housings, which control surfaces are located opposite the end faces of the cellular wheel in a pressure wave supercharger. The pressure waves periodically acting on the end faces of the cellular wheel also result in high gas pressures in the region of the labyrinth seals. The annular gap adjoining the sealing surface of the sealing profile prevents by means of a slight local pressure drop, when gas flows into the annular gap, that gas escapes through the gap formed between the sealing surface and the control surface opposite thereto, and thus prevents a pressure loss that reduces the output of the pressure wave supercharger.

For stabilizing the annular gap, spacer elements that are arranged distributed over the circumference of the sealing sleeves can protrude in the region of the end faces of the cellular wheel from the sealing sleeve side that faces toward the outer and/or inner sleeve. Alternatively, the spacer elements can be arranged distributed over the circumference of the outer and/or inner sleeve on that side of the outer and/or inner sleeve that faces toward the sealing sleeve.

Due to its reduced mass, the above-described embodiment of the sealing sleeves that form with the outer and/or inner sleeves an annular gap that is open at the end faces of the cellular wheel also results in lower centrifugal forces and thus in a higher dimensional stability with correspondingly improved sealing.

The length of the notches in the outer sleeve, the inner sleeve or the intermediate sleeve or, in the case of more than one intermediate sleeve, in at least one of the intermediate sleeves lies in the range of approximately 10% to 30% of the length of the cellular wheel, i.e., of the distance between the two end faces of the cellular wheel.

Preferably, the outer sleeve, the inner sleeve, the intermediate sleeve(s), the fins and the sealing sleeves are made of sheet metal with a thickness of less than 0.5 mm.

In a particularly preferred second embodiment of the cellular wheel according to the invention, the drive shaft has two annular webs which are arranged coaxial to the drive shaft and are spaced apart from one another and which have a circumferential surface as a support surface for the inner sleeve, and at least one of the annular webs is joined with the inner sleeve.

Expediently, that end of the inner sleeves that is located remote from the end faces of the cellular wheel is joined with one of the annular webs.

As a heat protection, the inner sealing sleeve can be joined with a cover on the hot gas side, i.e., on the side of the exhaust gas housing, at the end face of the cellular wheel. Alternatively or additionally, the annular web near the hot gas side can be joined with a cover.

With these measures, the drive axis can kept under operating conditions of a pressure wave supercharger at a relatively low temperature so that the axial clearance of the cellular wheel enclosed between gas and air housing can be set smaller in the cold operating state for maintaining a minimum clearance of approximately 0.03 to 0.05 mm over the entire speed range.

For weight reduction, the drive shaft is configured as a hollow shaft having a tubular end part, a conical intermediate part and a tubular shaft part having a receptacle for a coupling piece to be connected to a motor drive.

For further weight reduction, the tubular end part and the conical intermediate part expediently have openings that are arranged symmetrically over the circumference and also enable air circulation with corresponding cooling effect.

The coupling piece preferably has a coupling axle with longitudinal ribs which, when sliding the coupling piece into the receptacle of the tubular shaft part, engage in longitudinal grooves in the receptacle.

The cellular wheel according to the invention is preferably used in a pressure wave supercharger for supercharging combustion engines, in particular Otto engines with a cubic capacity of preferably 2 liter or less.

BRIEF DESCRIPTION OF THE DRAWING

Further advantages, features and details of the invention arise from the following description of preferred exemplary embodiments and from the drawing which merely serves for illustration and is not to be interpreted as limiting. In the figures, schematically

DESCRIPTION OF PREFERRED EMBODIMENTS

Figure 1:
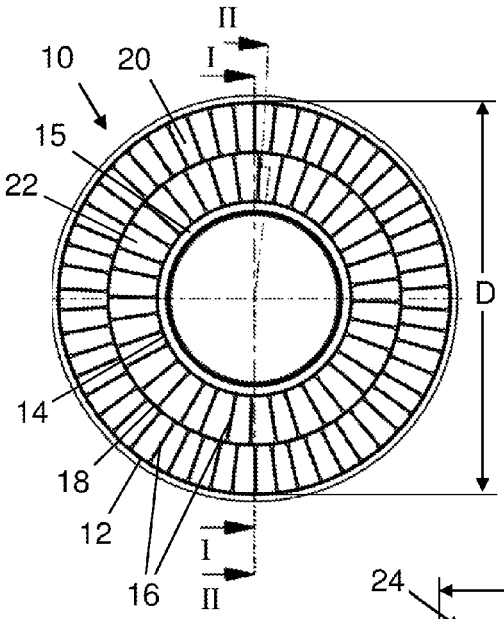
FIG. 1 shows a view on an end face of the cellular wheel illustrated in FIG. 4 for a pressure wave supercharger.
Figure 4:
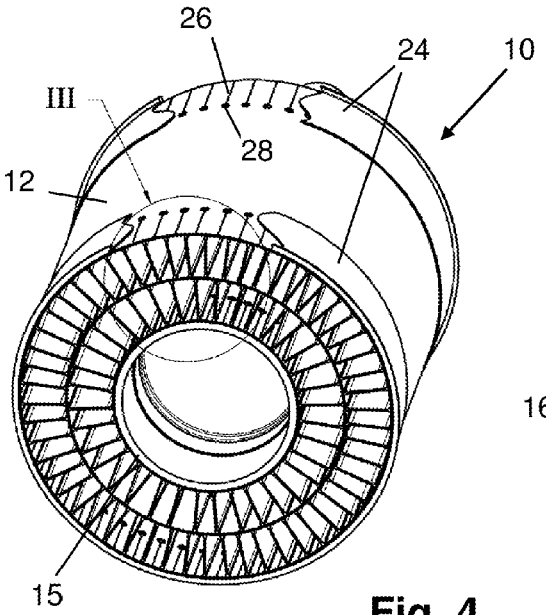
FIG. 4 shows a perspective view of a first embodiment of a cellular wheel for a pressure wave supercharger.

A cellular wheel 10, shown in the FIGS. 1 and 4, of a pressure wave supercharger that is not illustrated in the drawing consists of an outer sleeve 12 that is concentric to a rotational axis y of the cellular wheel 10, an inner sleeve 14 that is concentric to the outer sleeve 12, and an intermediate sleeve 18 that is arranged between and concentric to the outer sleeve 12 and the inner sleeve 14. The outer annular chamber between the intermediate sleeve 18 and the outer sleeve 12 and the inner annular chamber between the intermediate sleeve 18 and the inner sleeve 14 are divided into a multiplicity of outer cells 20 and a multiplicity of inner cells 22 by strip-shaped fins 16 arranged radially with regard to the rotation axis y. The exemplary illustrated cellular wheel 10 with a diameter D and a length L of, for example, in each case 100 mm has less than 60 outer cells 20 and less than 40 inner cells 22. The outer sleeve 12, the intermediate sleeve 18, the inner sleeve 14 and the fins 16 have a uniform wall thickness of, e.g., 0.4 mm and consist of a high-temperature resistant metallic material, e.g., Inconel 2.4856. In the direction of the rotational axis y, the mentioned parts have an identical length L corresponding to the length of the cellular wheel 10 and extend between two end faces 11 of the cellular wheel 10, the end faces being perpendicular to the rotational axis y. In the region of the two end faces 11, outer sealing sleeves 24 are arranged that extend circumferentially on the outer sleeve 12 and have a sealing surface 32 of a sealing profile 30 of a labyrinth seal, which sealing surface is aligned with the end face 11 of the cellular wheel 10. The mating surfaces for the sealing surfaces 32 required for the labyrinth seal are formed by the control surfaces of the exhaust gas and air housing, which control surfaces face the end faces 11 of the cellular wheel 10 in a pressure wave supercharger.

Figure 2:
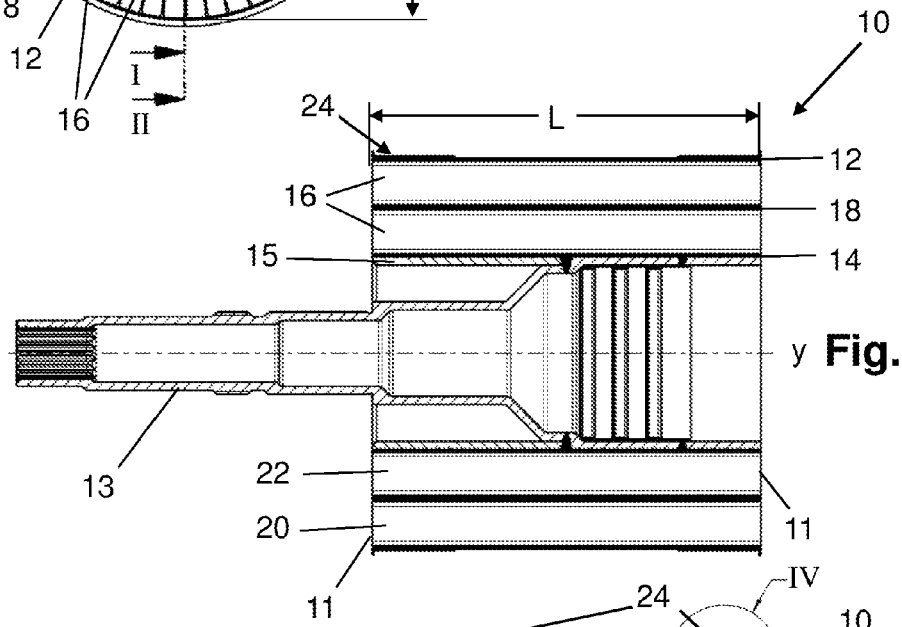
FIG. 2 shows a longitudinal sectional view through the cellular wheel of FIG. 4 attached onto a flange sleeve of a drive shaft, along the line I-I in FIG. 1.
Figure 3:
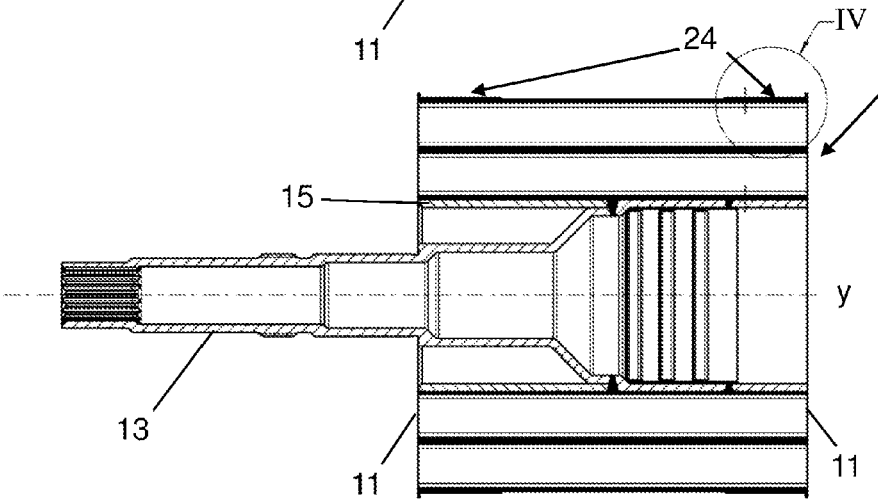
FIG. 3 shows a longitudinal section through the cellular wheel of FIG. 4 attached onto a flange sleeve of a drive shaft, along the line II-II in FIG. 1.

The cellular wheel 10 illustrated in the FIGS. 1 and 4 is connected, according to the FIGS. 2 and 3, to a drive shaft 13 by means of a flange sleeve 15. The flange sleeve 15 is aligned concentric to the drive shaft 13 and is welded thereto. The rotational axis of the drive shaft 13 corresponds here to the rotational axis y of the cellular wheel 10 attached onto the flange sleeve 15.

Figure 5:
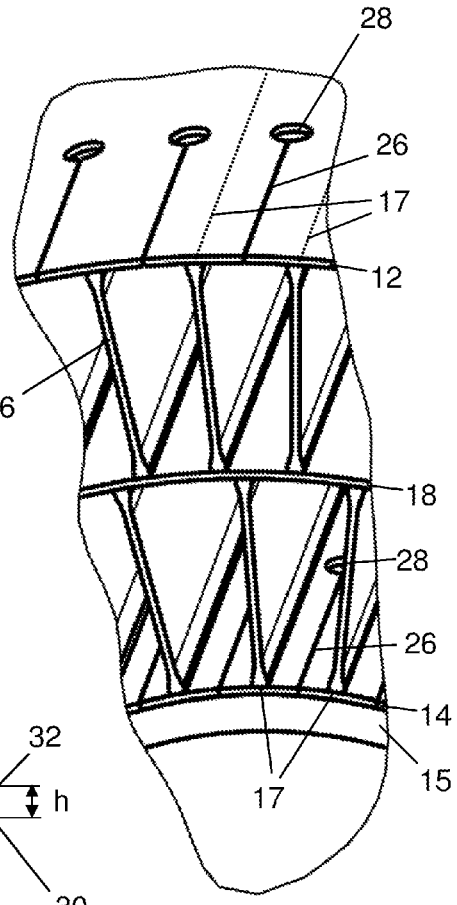
FIG. 5 shows a detail III of the cellular wheel of FIG. 4 in an enlarged illustration.

As shown in the FIGS. 4 and 5, notches 26 are arranged in the outer sleeve 12, namely between joints 17 of adjacent fins 16 with the outer sleeve 12. These notches 26 run parallel to the fins 16 and extend starting from each end face 11 of the cellular wheel 10 over a length e of, e.g., 15 mm. The notches 26 end in a circular recess 28 having a diameter f of e.g., 2 mm. In addition, the at least one intermediate sleeve 16 could also be provided with corresponding notches.

Figure 6:
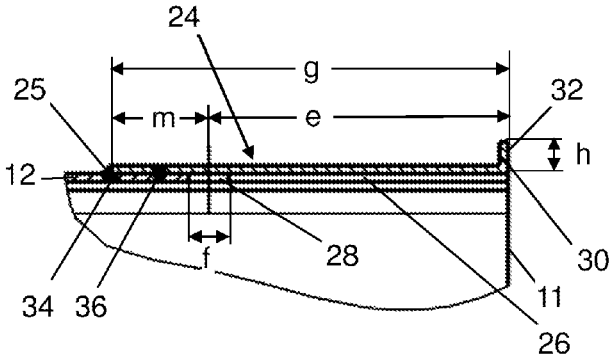
FIG. 6 shows a detail IV of the longitudinal section of the cellular wheel of FIG. 3 in an enlarged illustration.

The arrangement of the outer sealing sleeves 24 is shown in the FIGS. 4 and 6. The outer sealing sleeve 24 has a length g of, e.g., 20 mm. On the end face 11 of the cellular wheel 10, the outer sealing sleeve 24 transitions into an annular flange that protrudes outward perpendicular to the rotational axis y and forms the sealing profile 30 with the sealing surface 32 that is aligned with the end face 11 of the cellular wheel 10 and has a width h of, e.g., 1.5 mm. The outer sealing sleeve 24 is located on the outer sleeve 12 in a substantially positive-locking manner and protrudes with a free marginal edge 25 the circular recesses 28 at the free ends of the notches 26 by an amount of, e.g., 5 mm and is joined with the outer sleeve 12 via two circumferential weld seams 34, 36.

As shown in the FIGS. 4 and 5, notches 26 are also arranged in the inner sleeve 14, namely between joints 17 of adjacent fins 16 with the inner sleeve 14. These notches 26 run parallel to the fins 16 and extend starting from each end face 11 of the cellular wheel 10 over a length e of, e.g., 15 mm. The notches 26 end in a circular recess 28 with a diameter f of, e.g., 2 mm.

Also, in this embodiment, optional notches 26 can be arranged in the at least one intermediate sleeve.

Figure 7:
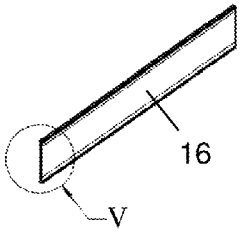
FIG. 7 shows a perspective view of a fin of the cellular wheel of FIG. 4.
Figure 8:
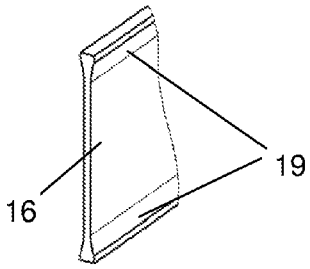
FIG. 8 shows a detail V of the fin of FIG. 7 in an enlarged illustration.

The fins 16 normally are rectangular strips having a constant thickness. Since the highest mechanical stress and thus an increased tendency of crack formation occurs near the joining zone, the fins may have a material thickening 19 in the region of their longitudinal edges (FIGS. 7 and 8). The area of the fins 16, which area is bordered by the two parallel longitudinal edges, can be plane or—viewed in the line of sight—can be curved toward one or both sides or can be provided with a bead so as to increase its dimensional stability.

For producing the cellular wheel 10, the inner sleeve 14, the inner diameter and length of which is matched with the outer diameter and the length of the flange sleeve 15, and which comprises the fins 16 that were previously joined with a longitudinal edge in a precise position with the inner sleeve 14 and that protrude radially outward with the free longitudinal edge, is provided with the notches 26 extending from both end faces 11 and with the circular recesses 28 at the ends of said notches. Subsequently, the inner sleeve 14 processed in this manner, together with the outwardly protruding fins 16, is attached coaxially in the axial direction y onto the flange sleeve 15 and is welded thereto by means of an NC-controlled laser beam, namely between the fins 16 in the region between the recesses 28 that are opposite to each other. The weld seam can be continuous from recess to recess or can extend in each case only over a length of 3 to 5 mm from each recess 28. In order to achieve an optimal tightness, a transverse weld seam can also be applied transverse to the adjacent fins 16 and at a short distance of, e.g., 2 to 3 mm from the recess 28. Here, the transverse weld seam can be supplemented at its ends by longitudinal weld seams of, e.g., 3 to 5 mm running parallel to the fins 16 so as to form a U-shaped weld seam.

In a next step, the intermediate sleeve 18, the inner diameter and length of which is matched with the inner sleeve's 14 outer diameter formed by the free longitudinal edges of the fins 16 protruding radially outward from the inner sleeve and with the length of the inner sleeve 14, and which comprises the fins 16 that were previously joined with a longitudinal edge with the intermediate sleeve 18 in a precise position and that protrude radially outward with the free longitudinal edge, is attached coaxially and precisely positioned in the axial direction y onto the free longitudinal edges of the fins 16 protruding radially outward from the inner sleeve 14. Subsequently, the intermediate sleeve 18 is welded by means of a laser beam by means of a bead on plate weld to the free end edges of the underlying fins 16 of the inner sleeve 14 thereby forming the inner cells 22.

In a further step, the outer sleeve 12, the inner diameter and length of which is matched with the intermediate sleeve's outer diameter formed by the free longitudinal edges of the fins 16 protruding radially outward from the intermediate sleeve 18 and with the length of the intermediate sleeve 18, is attached coaxially in the axial direction y onto the free longitudinal edges of the fins 16 protruding radially outward from the inner sleeve 14. Subsequently, the outer sleeve 12 is welded by means of a bead on plate weld to the free end edges of the underlying fins 16 of the intermediate sleeve 18 thereby forming the outer cells 20.

Now, the outer sleeve 12 is provided with the notches 26 extending from both end faces 11, and with the circular recesses 28 at the end of the notches.

Then, the outer sealing sleeves 24 are attached onto the outer sleeve 12 and connected thereto. For this, the outer sealing sleeve 24, the inner diameter of which is matched with the outer diameter of the outer sleeve 12, is attached coaxially in the axial direction y onto the outer sleeve 12, and the outer sealing sleeve's 24 free end protruding the circular recesses 28 at the ends of the notches 26 is joined with the outer sleeve 12 by means of two circumferential weld seams 34, 36.

The above-described joints are preferably implemented as weld seams generated by means of a laser or electron beam, in particular with a laser beam. However, the joints can also be soldered. Cutting the notches 26 and the recesses 28 is preferably also carried out by means of a laser or electron beam, in particular with a laser beam.

Figure 9:
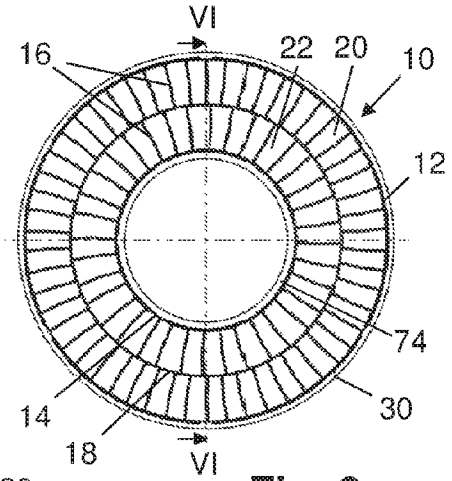
FIG. 9 shows a view on an end face of the cellular wheel illustrated in FIG. 15 for a pressure wave supercharger.
Figure 15:
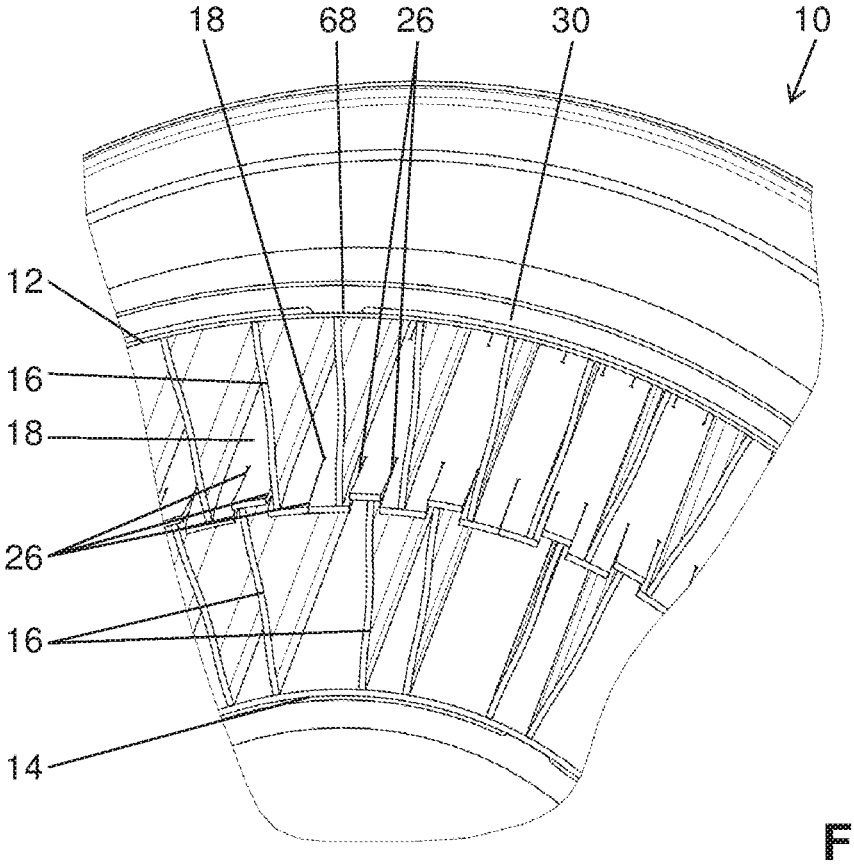
FIG. 15 shows a perspective view of another embodiment of a cellular wheel for a pressure wave supercharger.

A cellular wheel 10, shown in the FIGS. 9 and 15, of a pressure wave supercharger that is not illustrated in the drawing consists of a outer sleeve 12 located concentric to a rotational axis y of the cellular wheel 10, an inner sleeve 14 located concentric to the outer sleeve 12, and an intermediate sleeve 18 arranged between and concentric to the outer sleeve 12 and the inner sleeve 14. The outer annular chamber between the intermediate sleeve 18 and the outer sleeve 12, and the inner annular chamber between the intermediate sleeve 18 and the inner sleeve 14 are subdivided into a multiplicity of outer cells 20 and into a multiplicity of inner cells 22 by strip-shaped fins 16 arranged radial with regard to the rotational axis y. The exemplary illustrated cellular wheel 10 with a diameter D and a length L of, for example, in each case 100 mm has 54 outer cells 20 and 36 inner cells 22. The outer sleeve 12, the intermediate sleeve 18, the inner sleeve 14 and the fins 16 have a uniform wall thickness of, e.g., 0.4 mm and consist of a high-temperature resistant metallic material, e.g., Inconel 2.4856. In the direction of the rotational axis y, the mentioned parts have an identical length L corresponding to the length of the cellular wheel 10 and extend between two end faces 11 of the cellular wheel 10, which end faces are perpendicular to the rotational axis y. In the region of the two end faces 11, outer sealing sleeves 24 are arranged that extend circumferentially on the outer sleeve 12 and have a sealing surface 32 of a sealing profile 30 of a labyrinth seal, which sealing surface is aligned with the end face 11 of the cellular wheel 10. The mating surfaces for the sealing surfaces 32 required for the labyrinth seal are formed by the control surfaces of the exhaust gas and air housing, which control surfaces face the end faces 11 of the cellular wheel 10 in a pressure wave supercharger.

Figure 10:
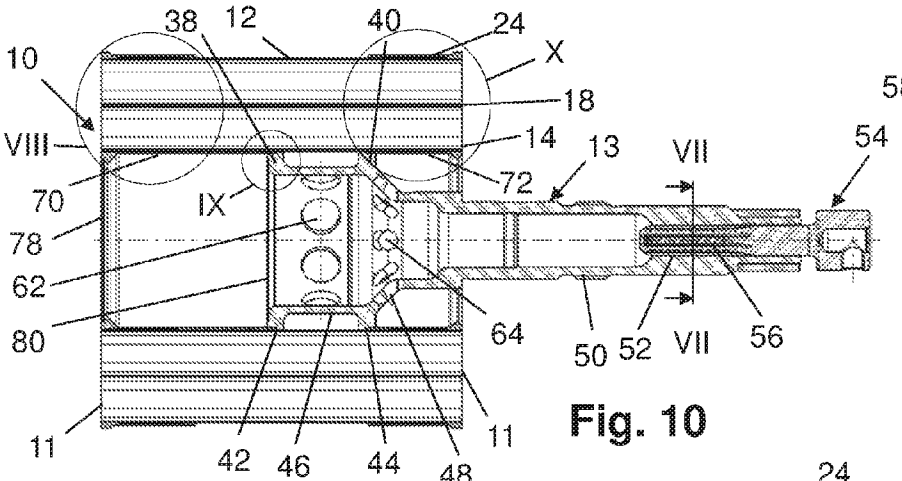
FIG. 10 shows a longitudinal section through the cellular wheel of FIG. 15 attached onto the drive shaft, along the line VI-VI in FIG. 9.
Figure 13:
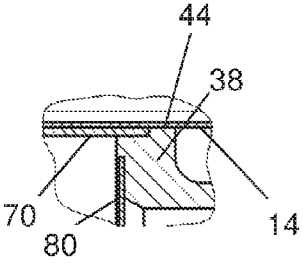
FIG. 13 shows a second detail IX of the longitudinal section of the cellular wheel of FIG. 10 in an enlarged illustration.

In the case of the cellular wheel 10 illustrated in the FIGS. 9 and 15, the inner sleeve 14 according to FIG. 10 is directly connected to a drive shaft 13. The drive shaft 13 is configured as a hollow shaft having two annular webs 38, 40 that are spaced apart from each other and protrude radially from a tubular end piece 46. The end surfaces 42, 44 of the annular webs 38, 40 rest against the inner sleeve 14 that is aligned concentrically with the drive shaft 13, wherein only the annular web 38 located more remote from the drive side is joined with the inner sleeve 14, e.g., by means of a circumferential laser weld seam. The rotation axis of the drive shaft 13 corresponds to the rotational axis y of the inner sleeve 14 or the cellular wheel 10 attached onto the drive shaft 13.

Figure 11:
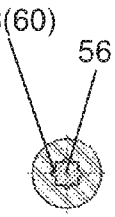
FIG. 11 shows a cross-section through the drive shaft along the line VII-VII in FIG. 10.

Connected to the tubular end part 46 of the drive shaft 13 is a conical intermediate part 48 which transitions into a substantially tubular shaft part 50 that comprises a receptacle 52 for a coupling piece 54 that is to be connected to a motor drive. The coupling piece 54 has a coupling axle 56 with longitudinal ribs 58 which, when inserting the coupling piece 54 into the receptacle 52 of the tubular shaft part 50, engage in corresponding longitudinal grooves 60 in the receptacle 52 (FIG. 11).

As shown in FIG. 10, first openings 62 arranged symmetrically over the circumference are provided between the two annular webs 38, 40 in the tubular end part 46 of the drive shaft 13. In the conical intermediate part 48, second openings 64 are provided which are likewise arranged symmetrically over the conical circumferential surface. The openings 62, 64 serve for weight reduction and result in addition in air circulation with corresponding cooling effect.

Figure 16:
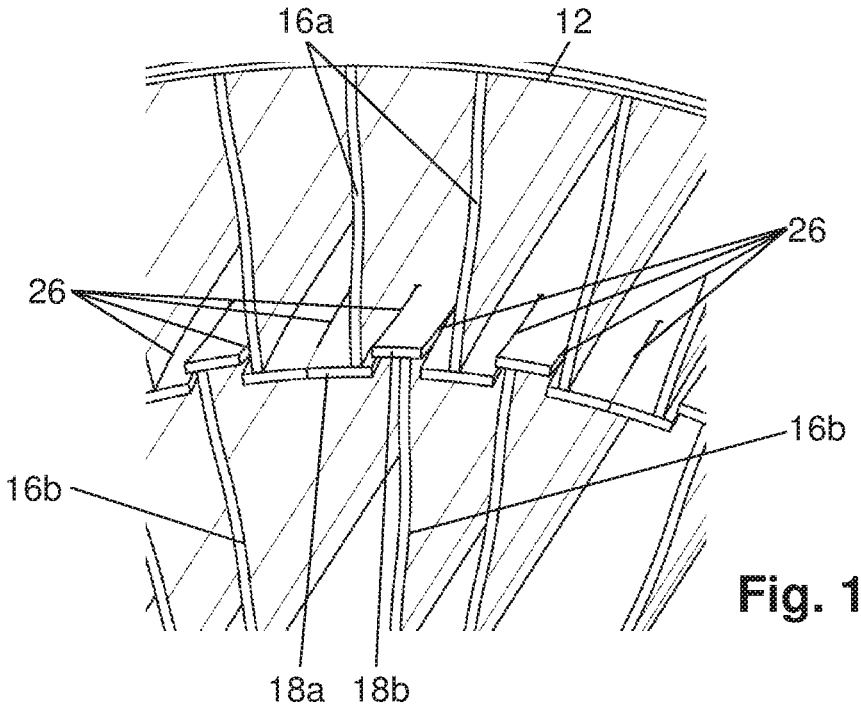
FIG. 16 shows a detail of the cellular wheel of FIG. 15 in an enlarged illustration.

FIGS. 15 and 16 show a further embodiment of the cellular wheel 10. The cellular wheel 10 can be used, for example, on the drive shaft 13 according to FIG. 2 or FIG. 10. As shown in the FIGS. 15, 16 and 17, notches 26 are arranged in the intermediate sleeve 18, namely between joints 17 of adjacent fins 16 with the intermediate sleeve 18. These figures show that embodiment in which the notches 26 are arranged solely in the intermediate sleeve 18, and the outer sleeve 12 and the inner sleeve 14 have no notches. However, the following description can also be applied to the above-described embodiment having the notches in the outer sleeve 12 and/or intermediate sleeve 18 and/or inner sleeve 14.

These notches 26 in the intermediate sleeve 18 run parallel to the fins 16 and extend starting from each end face 11 of the cellular wheel 10 or the intermediate sleeve 18 over a length of, e.g., 15 mm. The notches 26 end in a circular recess 28 with a diameter of, e.g., 2 mm.

Figure 18:
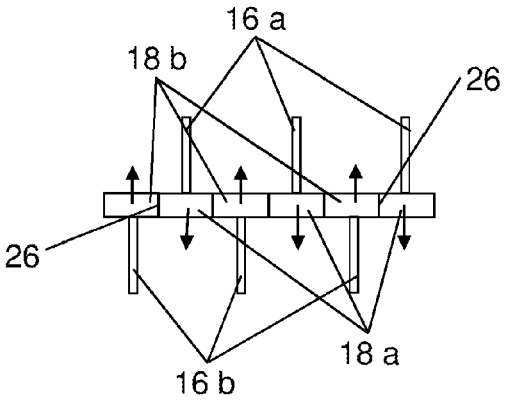
FIG. 18 shows an enlarged cut-out of FIG. 17 in a first operating state of the cellular wheel.
Figure 19:
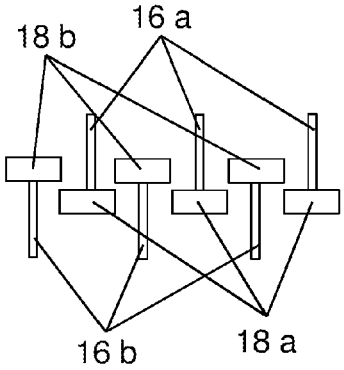
FIG. 19 shows an enlarged cut-out of FIG. 17 in a second operating state of the cellular wheel.

The function of the notches 26 is explained in more detail hereinafter with reference to the FIGS. 18 and 19 and also the FIGS. 15 and 16. FIGS. 18 and 19 show schematically a cut-out viewed in the direction of the rotational axis y. FIG. 19 represents the state of the FIGS. 15 and 16 in which the fins 16 and also parts of the intermediate sleeve 18 are deformed due to the temperature changes described below.

The operating conditions prevailing in a pressure wave supercharger result on the hot gas side and also on the cold gas side in temperature changes which occur in rapid succession and which, inside the cellular wheel 10 in a region extending from the end faces 11 up to a depth of approximately 20 mm, amount to 200 to 300° C. and cause in this region periodic, greatly fluctuating thermal expansions and thermal contractions of the fins 16 in the radial direction. These expansions and/or contractions represent significant stress for the material, and tests have shown that cracks occur in the region of the fins 16. The cracks extend either along the joint 17 or in the fin 16 itself, whereby a crack in the fin 16 can be initiated.

FIG. 18 shows an operating state in which the cellular wheel 10 is at a substantially constant operating temperature over its entire length in the axial direction. Accordingly, under these conditions, there is no difference over the entire length of the cellular wheel 10 with regard to the thermal expansion of the fins 16 in the radial direction.

FIGS. 15, 16 and 19 show an operating state in which the fins 16 have a temperature in an edge region of the cellular wheel 10, which edge region extends from an end face 11 of the cellular wheel 10 up to a depth of approximately 15 to 20 mm, that is 200 to 300° C. higher than the temperature in an inner region of the cellular wheel 10. Under these conditions, the higher temperature of the fins 16 in the edge region results in a thermal expansion that is greater than compared to the fins inside the cellular wheel 10. Due to the notches 26 arranged between joints 17 of adjacent fins 16 with the intermediate sleeve 18, the intermediate sleeve 18 is divided into edge strips 18*a*, 18*b* in the edge region of the cellular wheel 10 so that adjacent edge strips 18*a*, 18*b* are displaceable relative to each other in the radial direction. Because of this, each fin 16*a*, 16*b* together with the edge strip 18*a*, 18*b* joined therewith can expand from its original position in the intermediate sleeve 18 in the radial direction, without the risk that due to temperature-related fast load changes in rapid succession, tensile stresses build up and are relieved in the fins 16 themselves and in the region of their joints 17 with the outer and inner sleeves 12, 14 and can cause damage to the material. The operating state shown in the FIGS. 15, 16 and 19 is a result of the fast periodic temperature increases on the hot gas side of the cellular wheel 10. Through the arrangement of the notches 26, thus, deformation of the fins 16 in the radial direction is enabled, which largely prevents stresses in the region of the fins 16.

The compensation of the temperature-related expansion of the fins 16 is now explained again with reference to FIG. 16. The fin 16*a* is allocated to an edge strip 18*a* of the intermediate sleeve 18, which edge strip is formed by two notches 26 located to the left and the right of the fin 16*a*. In other words, it can also be said that by means of the notches 26, an edge strip 18*a* protruding from the base body of the intermediate sleeve 18 is formed. The fin 16*a* is firmly connected to the edge strip 18*a* via the joint 17. During a temperature increase, the fin 16*a* deforms in the radial direction in the front region via the edge strip 18*a*, and this deformation can be compensated by a movement of the edge strip 18*a* in the direction of the rotational axis y. In the fin 16*a* itself, no stress, or greatly reduced stress is created.

With regard to the fin 16*b*, the explanations just given can be repeated, wherein the deformation takes place away from the rotational axis y. The fin 16*b* is connected here to an edge strip 18*b*, wherein during a deformation of the fin 16*b*, the corresponding edge strip 18*b* deforms. The edge strip 18*b* is provided by two notches 26 that extend to the left and the right of the fin 16*b* into the intermediate sleeve 18.

The rapid temperature changes on the cold gas side result in an operating state in which the fins 16 in the edge region of the cellular wheel 10 are at a temperature that is lower by 200 to 300° C. than compared to the fins inside the cellular 10. Under these conditions, the temperature of the fins 16 that is lower in the edge region of the cellular wheel 10 than compared to the fins inside the cellular wheel 10, results in a stronger contraction in the radial direction. Thus, each fin 16*a*, 16*b* together with the edge strip 18*a*, 18*b* joined therewith can contract from its original position in the intermediate sleeve 18 in the radial direction, without the risk that due to temperature-related fast load changes in rapid succession, compressive stresses build up and are relieved in the fins 16 themselves and in the region of their joints 17 with the outer and inner sleeves 12, 14 and can cause damage to the material.

Figure 14:
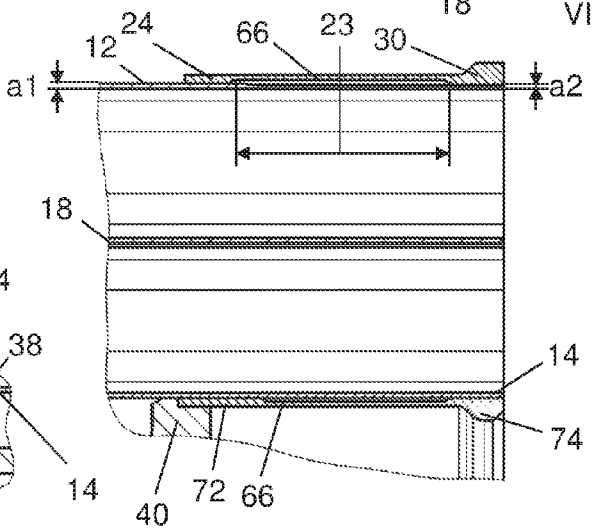
FIG. 14 shows a third detail X of the longitudinal section of FIG. 10 in an enlarged illustration.
Figure 12:
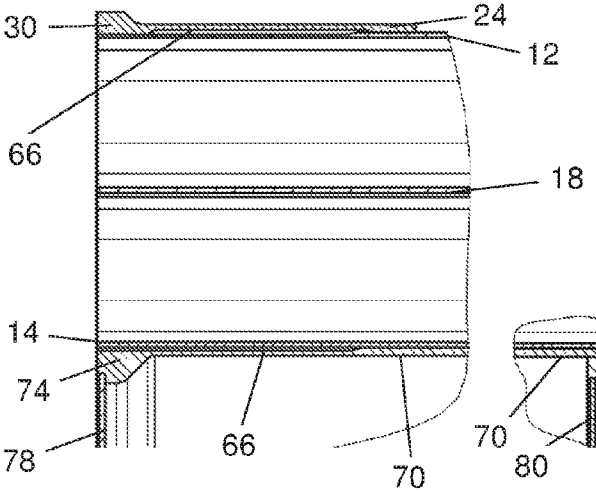
FIG. 12 shows a first detail VIII of the longitudinal section of the cellular wheel of FIG. 10 in an enlarged illustration.
Figure 20:
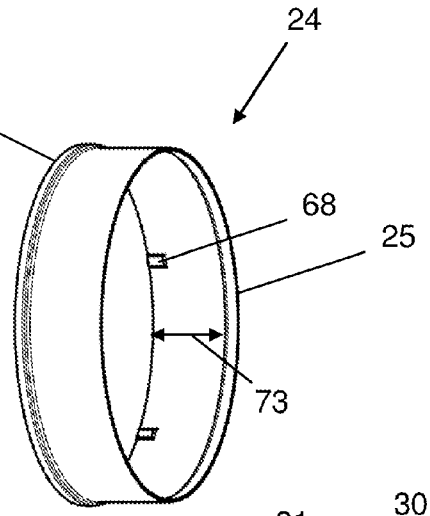
FIG. 20 shows a perspective view of an outer sealing sleeve of the cellular wheel of FIG. 15.
Figure 22:
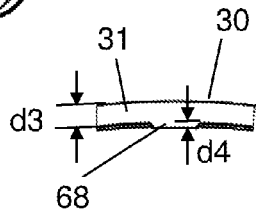
FIG. 22 shows a cut-out of the view onto the end face of the outer sealing sleeve of FIG. 20.
Figure 21:
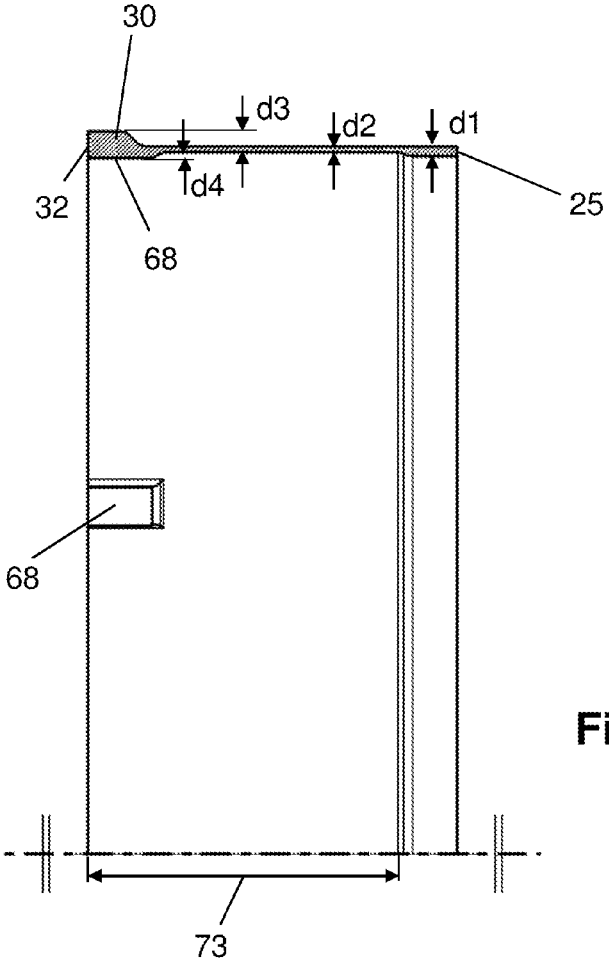
FIG. 21 shows an axial section through the outer sealing sleeve of FIG. 20.

The arrangement of the outer sealing sleeves 24 is shown in the FIGS. 12, 14 and 15. The cylindrical outer sealing sleeves 24 have a width of, e.g., 20 mm. On both end faces 11 of the cellular wheel 10, the outer sealing sleeves 24 illustrated in the FIGS. 20 to 22 have a sealing profile 30 that protrudes radially outward and has a sealing surface 32 that is aligned with the end face 11 of the cellular wheel 10 and has a width d3 of, e.g., 1.5 mm so as to form a labyrinth seal. In a region remote from the end face 11 of the cellular wheel 10, the outer sealing sleeve 24 is attached in a substantially positive-locking manner on the outer sleeve 12 and is joined with the outer sleeve 12 in this region via a circumferential weld seam 34. From the end face 11 of the cellular wheel 10 up to the joining region with the outer sleeve 12, the outer sealing sleeve 24 having a wall thickness d1 of, e.g., 0.25 mm has a thickness-reduced region 23 with a thickness d2 of, e.g., 0.13 mm and thus has a radial distance from the outer sleeve 12 so that from the end faces 11 of the cellular wheel 10 up to the joining region of the outer sealing sleeve 24 with the outer sleeve 12, an annular gap 66 is created between the sealing sleeve 24 and the outer sleeve 12, which gap is open at the end faces 11 of the cellular wheel 10. For stabilizing the position of sealing sleeve 24 and outer sleeve 12 relative to each other, the sealing sleeve 24 has noses as spacers 68 with a height d4 of, e.g., 0.13 mm that are located underneath the sealing profile 30 and protrude radially inward. For example, six spacers 68 are arranged uniformly distributed over the circumference of the sealing profile 30 of the sealing sleeve 24.

Figure 23:
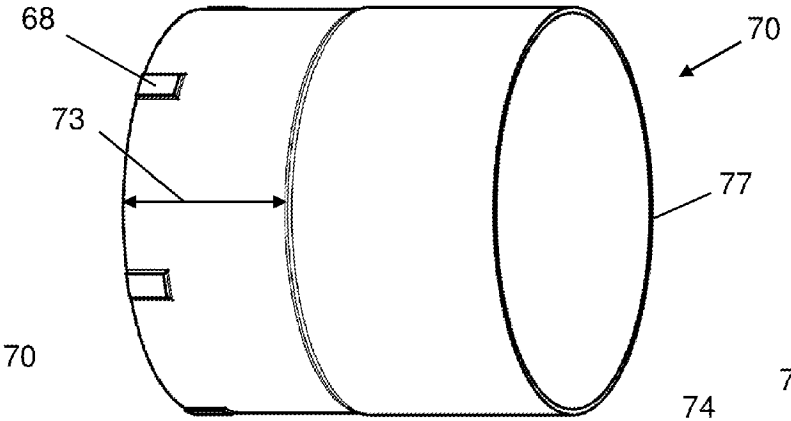
FIG. 23 shows a perspective view of a first (hot-gas-side) inner sealing sleeve of the cellular wheel of FIG. 15.
Figure 25:
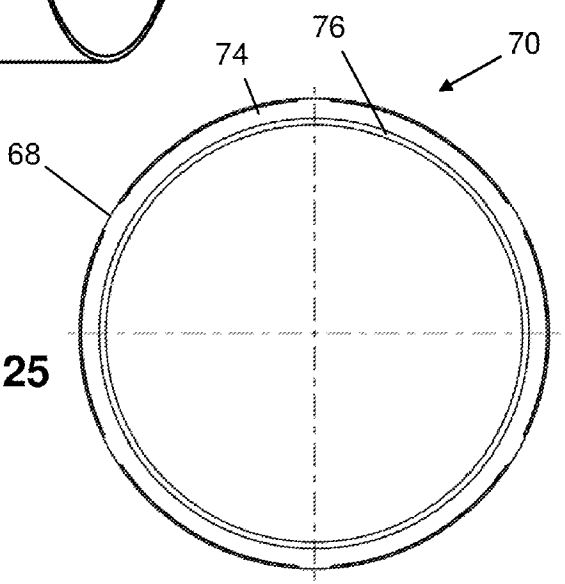
FIG. 25 shows a view on the end face of the hot-gas-side inner sealing sleeve of FIG. 24.
Figure 24:
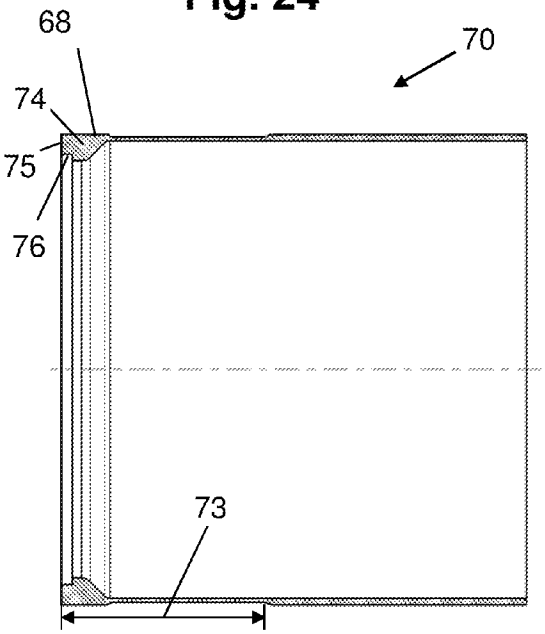
FIG. 24 shows an axial section through the hot-gas-side inner sealing sleeve of FIG. 23.
Figures 26, 27, 28:
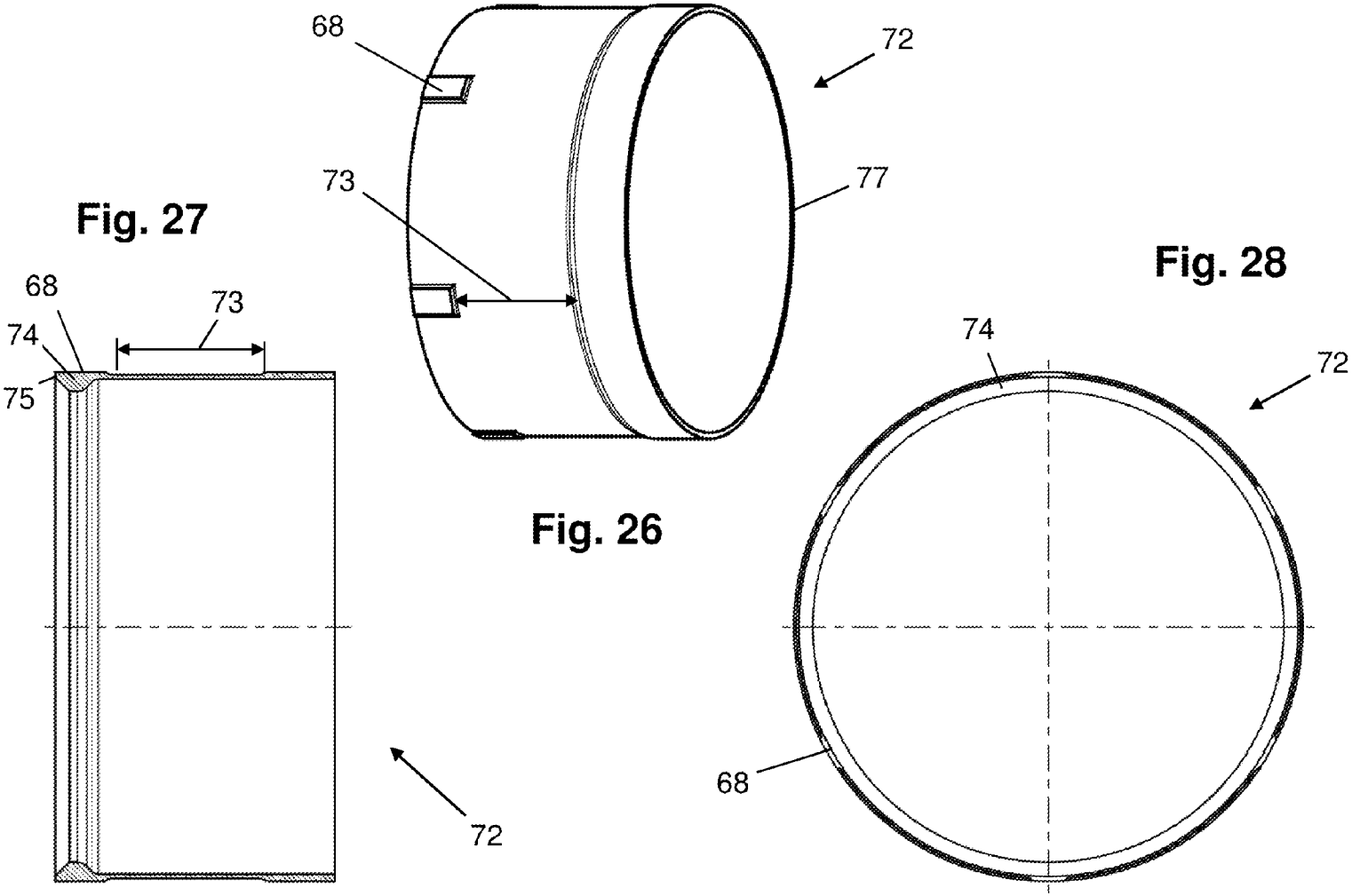
FIG. 26 shows a perspective view of a second (cold-gas-side) inner sealing sleeve of the cellular wheel of FIG. 15.
FIG. 27 shows an axial section through the cold-gas-side inner sealing sleeve of FIG. 26.
FIG. 28 shows a view onto the end face of the cold-gas-side inner sealing sleeve of FIG. 27.

A shown in the FIGS. 10, 12, 13, 14 and 17, a first inner sealing sleeve 70 illustrated in the FIGS. 23 to 25 and a second inner sealing sleeve 72 illustrated in the FIGS. 26 to 28 are inserted in the inner sleeve 14. The first inner sealing sleeve 70 is arranged on the hot gas side, the second inner sealing sleeve 72 is arranged on the cold gas side of the cellular wheel 10.

At the end faces 11 of the cellular wheel 10, the inner sealing sleeves 70, 72 have a radially inward protruding sealing profile 74 in the form of an annular web that has sealing surface 75 with a width of, e.g., 1.5 mm, which sealing surface is aligned with the end face 11 of the cellular wheel. In a region of, e.g., in each case 20 mm, extending from the end faces 11 of the cellular wheel 10 into the inner sleeve 14, the inner sealing sleeves 70, 72 have a thickness-reduced region 73 and thus a radial distance from the inner sleeve 14 so that starting from the end faces 11 of the cellular wheel 10, an annular gap 66 arises between the inner sealing sleeve 70, 72 and the inner sleeve 14, which gap is open at the end faces 11 of the cellular wheel 10. Subsequent to the annular gap 66, the inner sealing sleeves 70, 72 of the inner sleeve 14 engage in a substantially positive-locking manner, extend to the respective nearer annular web 38, 40 at the tubular end part 46 of the drive shaft 13, and are joined with the respective annular web 38, 40 by means of a circumferential weld seam. The annular webs 38, 40 at the tubular end part 46 of the drive shaft 13 are joined with the inner sleeve 14 by means of a circumferential weld seam. On that end face 11 of the cellular wheel 10 that is farther away from the drive side, i.e., on the hot gas side, the sealing profile 74 is welded to an outer cover 78 that closes the inner sleeve 14. Likewise, the annular web 38 that is farther away from the drive side at the tubular end part 46 of the drive shaft 13 is welded to an inner cover 80 that closes the inner sleeve 14 inside the cellular wheel 10. For stabilizing the position of inner sealing sleeve 70, 72 and inner sleeve 14 relative to each other, the inner sealing sleeves 70, 72 are provided on the outer side, namely over the sealing profile 74, with radially outward protruding noses as spacers 68 with respect to the inner sleeve 14. For example, six spacers 68 are arranged uniformly distributed over the circumference of the inner sealing sleeve 70, 72. The values given above for the dimensions d1, d2, d3 and d4 for the outer sealing sleeves 24 shown in the FIGS. 20 to 22 also apply to the inner sealing sleeves 70, 72 shown in the FIGS. 23 to 28.

Figure 17:
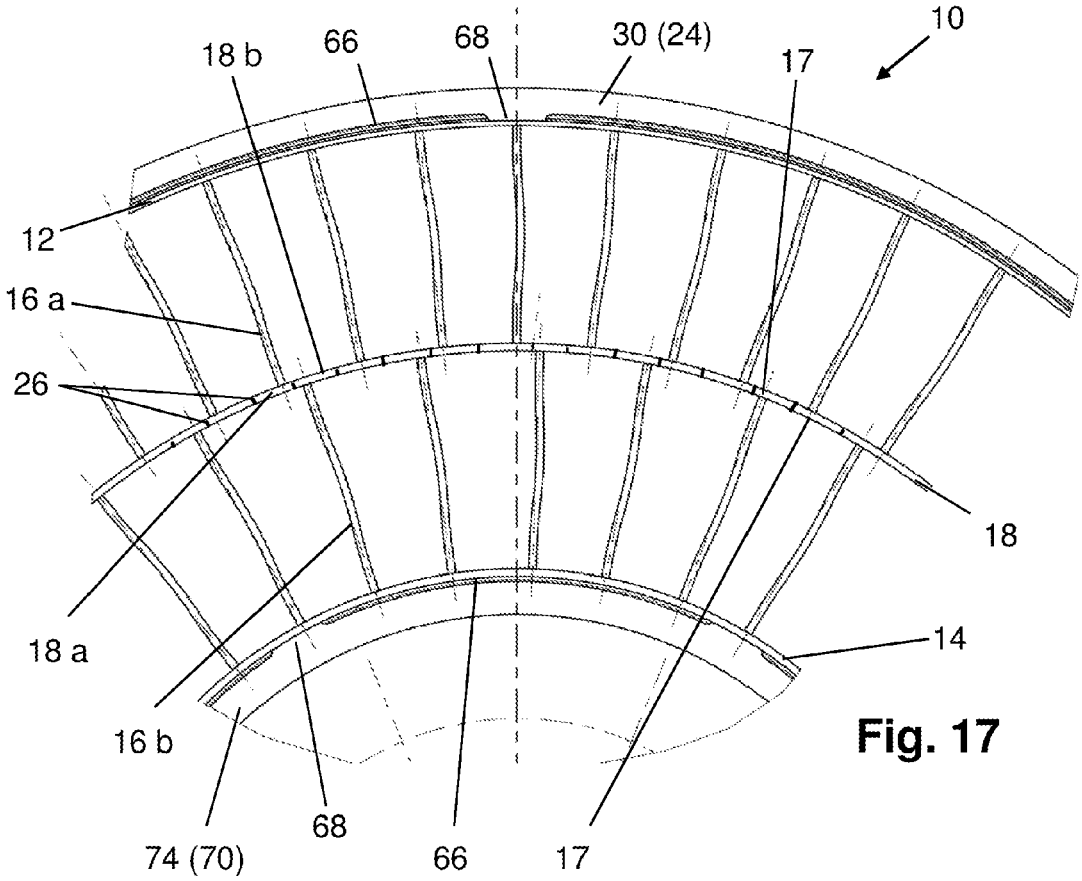
FIG. 17 shows an enlarged cut-out of the view of FIG. 9 onto the end face of the cellular wheel illustrated in FIG. 15 for a pressure wave supercharger.

It is apparent in particular from the FIGS. 12, 14 and 17 and the FIGS. 20 to 28 that for generating the open annular gap 66 at the end face 11 of the cellular wheel 10, namely between the sealing sleeves 24, 70, 72 and the outer and, respectively, inner sleeve 12, the inner diameter of the sealing sleeves 24, 70, 72 is increased while the outer diameter remains constant. This can be achieved by thinning the material through solid forming, wherein the material displaced from the annular gap region serves for forming the sealing profile 30, 74. For increasing the annular gap width between the outer sealing sleeves 24 and the outer sleeve 12, the outer diameter of the outer sleeve 12 is additionally reduced in the annular gap region, as shown in the FIGS. 12 and 14, while the inner diameter remains the same. Here, the wall thickness a1 of the outer sleeve 12 is, e.g., 0.25 mm and the thickness a2 of the thickness-reduced region 23 is, e.g., 0.13 mm. The annular gap width between the inner sealing sleeves 70, 72 and the inner sleeve 14 can be increased in the same manner by reducing the inner diameter of the inner sleeve 14 while the outer diameter remains the same, wherein the values a1 and a2 given above for the outer sleeve 12 also apply to the inner sleeve 14.

For producing the cellular wheel 10, the inner sleeve 14 is provided with the fins 16 which are accurately positioned with a longitudinal edge and protrude radially outward with the free longitudinal edge. Subsequently, the intermediate sleeve 18, the inner diameter and length of which are matched with the outer diameter, formed by the free longitudinal edges of the fins 16 radially protruding from the inner sleeve, and with the length of the inner sleeve 14, and which comprises the fins 16 that were previously joined precisely positioned with a longitudinal edge with the intermediate sleeve 18 and that protrude radially outward with the free longitudinal edge, are attached coaxially and precisely positioned in the axial direction y onto the free longitudinal edges of the fins 16 protruding radially outward from the inner sleeve 14. Then, the intermediate sleeve 18 is welded by means of a bead on plate weld to the free end edges of the underlying fins 16 of the inner sleeve 14, thereby forming the inner cells 22. Subsequently, the intermediate sleeve 18 is provided with the notches 26 which extend from both end faces 11, and with the circular recesses 28 at the end of the notches.

In a next step, the outer sleeve 12, the inner diameter and length of which are matched with the outer diameter, formed by the free longitudinal edges of the fins 16 protruding radially outward from the intermediate sleeve 18, and with the length of the intermediate sleeve 18, is attached coaxially in the axial direction y onto the free longitudinal edges of the fins 16 protruding radially outward from the intermediate sleeve 14. Then, the outer sleeve 12 is welded by means of a bead on plate weld with a laser beam to the free end edges of the underlying fins 16 of the intermediate sleeve 18, thereby forming the outer cells 20.

In a further step, the outer sealing sleeves 24, the inner diameter of which is matched with the outer diameter of the outer sleeve 12, are attached coaxially in the axial direction y onto the outer sleeve 12 and are joined therewith. Likewise, the inner sealing sleeves 70, 72, the outer diameter of which is matched with the inner diameter of the inner sleeve 14, are inserted coaxially in the axial direction y in the inner sleeve 14 and are joined therewith and with the annular webs 38, 40 at the tubular end part 46 of the drive shaft 13. Subsequently, the inner and the outer covers 80, 78 are inserted and are joined with the annular web 38 on the tubular end part 46 and, respectively, with the annular web 74 on the sealing sleeve 70 on the hot gas side.

The above-described joints are preferably implemented as weld seams generated by means of a laser or electron beam, in particular with a laser beam. However, the joints can also be soldered. Cutting the notches 26 and the recesses 28 is likewise preferably carried out by means of a laser or electron beam, in particular with a laser beam, wherein a minimal cutting width of approximately 15 μm is achieved.

| Reference list | |
|---|---|
| 10 | Cellular wheel |
| 11 | End faces |
| 12 | Outer sleeve |
| 13 | Drive shaft |
| 14 | Inner sleeve |
| 15 | Flange sleeve |
| 16 | Fins |
| 17 | Joints 16/12, 16/14 |
| 18 | Intermediate sleeve |
| 19 | Thickening on 16 |
| 20 | Outer cells |
| 22 | Inner cells |
| 23 | Thickness-reduced region |
| 24 | Outer sealing sleeve |
| 25 | Marginal edge of 24 |
| 26 | Notches in 12, 14, 18 |
| 28 | Recess |
| 30 | Sealing profile |
| 32 | Sealing surface on 30 |
| 34, 36 | Joints 24/12 |
| 38, 40 | Annular webs |
| 42, 44 | End surfaces |
| 46 | Tubular end part |
| 48 | Conical intermediate part |
| 50 | Tubular shaft part |
| 52 | Receptacle |
| 54 | Coupling piece |
| 56 | Coupling axle |
| 58 | Longitudinal ribs |
| 60 | Longitudinal grooves |
| 62 | First openings |
| 64 | Second openings |
| 66 | Annular gap |
| 68 | Noses/spacers |
| 70 | First inner sealing sleeve |
| 72 | Second inner sealing sleeve |
| 73 | Thickness-reduced region |
| 74 | Sealing profile |
| 75 | Sealing surface of 74 |
| 76 | Recess |
| 77 | Marginal edge of 70, 72 |
| 78 | Outer cover |
| 80 | Inner cover |
| y | Rotational axis |
| a1 | Thickness of 12, 14, 18 |
| a2 | Thickness of 23 |
| d1 | Thickness of 24, 70, 72 |
| d2 | Thickness of 73 |
| d3 | Thickness of 74 |
| d4 | Thickness of 68 |
| e | Length of 26 |
| f | Diameter of 28 |
| g | Width of 24 |
| h | Width of 32 |
| m | Interference of 24 |

The invention claimed is:

1. A cellular wheel made of metal, comprising an outer sleeve arranged coaxial to a rotational axis, an inner sleeve arranged coaxial to the outer sleeve, at least one intermediate sleeve arranged between and coaxial to the outer sleeve and the inner sleeve, fins that are arranged between successive sleeves and are aligned substantially radially with regard to the rotational axis and joined with adjacent sleeves, outer sealing sleeves that engage over the outer sleeve and are joined with the outer sleeve and have a sealing profile for a labyrinth seal, and a drive shaft that lies in the rotational axis, wherein the cellular wheel has two end faces; and wherein at least the outer sleeve, the inner sleeve and/or the intermediate sleeve or at least one of the intermediate sleeves have notches extending, between adjacent fins, from both end faces of the cellular wheel.

2. The cellular wheel according to claim 1, wherein the notches end in recesses.

3. The cellular wheel according to claim 2, wherein the recesses have a dimension of 1 to 2 mm.

4. The cellular wheel according to claim 1, wherein in each case two adjacent notches form an edge strip associated with the respective sleeve, wherein a single edge strip is allocated in each case a single fin.

5. The cellular wheel according to claim 1, wherein the inner sleeve is located on a flange sleeve that is arranged coaxially to said inner sleeve and is joined with the drive shaft, and the outer sleeve has notches extending, between adjacent fins, from both end faces of the cellular wheel, wherein a marginal edge of the outer sealing sleeves, which marginal edge is located remote from the end faces of the cellular wheel, protrudes the notches by an amount, and the outer sealing sleeves are joined with the outer sleeve only in the region protruding the notches.

6. The cellular wheel according to claim 5, wherein the inner sleeve has notches extending, between adjacent fins, from both end faces of the cellular wheel, and the inner sleeve is joined with the flange sleeve between adjacent fins between notches located opposite to each other.

7. The cellular wheel according to claim 1, wherein the sealing profile of the outer sealing sleeves has a sealing surface that is aligned with the end faces of the cellular wheel, and the outer sealing sleeves form with the outer sleeve an annular gap that is open at the end faces of the cellular wheel.

8. The cellular wheel according to claim 1, wherein the inner sleeve is joined with the drive shaft, and the intermediate sleeve(s) has (have) notches extending, between adjacent fins, from both end faces of the cellular wheel.

9. The cellular wheel according to claim 1, wherein the sealing profile of the outer sealing sleeves has a sealing surface that is aligned with the end faces of the cellular wheel, and in the inner sleeve, inner sealing sleeves joined with the inner sleeve are arranged, which inner sealing sleeves have a sealing profile with a sealing surface that is aligned with the end faces of the cellular wheel for forming a labyrinth seal.

10. The cellular wheel according to claim 9, wherein the outer and inner sealing sleeves are joined with the outer and inner sleeves, respectively, only in a region of an end located remote from the end faces of the cellular wheel, and form with the outer and inner sleeves, respectively, an annular gap that is open at the end faces of the cellular wheel.

11. The cellular wheel according to 10, wherein a volume of the annular gap is increased by a wall thickness of the outer and inner sealing sleeves that is reduced in the region of the annular gap; or wherein a volume of the annular gap is increased by a wall thickness of the outer and inner sleeves respectively, that is reduced in the region of the annular gap.

12. The cellular wheel according to claim 10, wherein for stabilizing the annular gap, spacer elements that are arranged distributed over the circumference of the outer and inner sealing sleeves protrude in the region of the end faces of the cellular wheel from that side of the outer and inner sealing sleeves that faces toward the outer and inner sleeves, respectively.

13. The cellular wheel according to claim 10, wherein for stabilizing the annular gap, spacer elements that are arranged distributed over the circumference of the outer and inner sleeves, respectively, protrude in the region of the end faces of the cellular wheel from that side of the outer and inner sleeves, respectively, that faces toward the outer and inner sealing sleeves.

14. The cellular wheel according to claim 9, wherein an end of the inner sealing sleeves, which end is located remote from the end faces of the cellular wheel, is joined with an annular web, and/or wherein an inner sealing sleeve at an end face of the cellular wheel is joined with a cover, and/or wherein an annular web is joined with a cover.

15. The cellular wheel according to claim 1, wherein the length of the notches is 10% to 30% of the length of the cellular wheel; and/or wherein the outer sleeve, the inner sleeve, the intermediate sleeve(s), the fins and the sealing sleeves are made from sheet metal having a thickness of less than 0.5 mm.

16. The cellular wheel according to claim 1, wherein the drive shaft has two annular webs which are arranged coaxial to the drive shaft and spaced apart from one another and which have a circumferential surface as support surfaces for the inner sleeve, and at least one of the annular webs is joined with the inner sleeve.

17. The cellular wheel according to claim 1, wherein the drive shaft is configured as a hollow shaft having a tubular end part, a conical intermediate part and a tubular shaft part with a receptacle for a coupling piece to be connected to a motor drive.

18. The cellular wheel according to claim 17, wherein the tubular end part and the conical intermediate part have openings that are arranged symmetrically over the circumference, and/or wherein the coupling piece has a coupling axle with longitudinal ribs which, when sliding the coupling piece into the receptacle of the tubular shaft part, engage in longitudinal grooves in the receptacle.

19. A use of a cellular wheel according to claim 1, in a pressure wave supercharger for supercharging internal combustion engines or Otto engines.

20. A cellular wheel made of metal, comprising an outer sleeve arranged coaxial to a rotational axis, an inner sleeve arranged coaxial to the outer sleeve, at least one intermediate sleeve arranged between and coaxial to the outer sleeve and the inner sleeve, fins that are arranged between successive sleeves and are aligned substantially radially with regard to the rotational axis and joined with adjacent sleeves, outer sealing sleeves that engage over the outer sleeve and are joined with the outer sleeve and have a sealing profile for a labyrinth seal, and a drive shaft that lies in the rotational axis, wherein the cellular wheel has two end faces; and wherein solely the intermediate sleeve or solely at least one of the intermediate sleeves has notches extending between adjacent fins, from the two end faces of the cellular wheel.

21. The cellular wheel according to claim 20, wherein the notches end in recesses.

22. The cellular wheel according to claim 20, wherein in each case two adjacent notches form an edge strip associated with the respective sleeve, wherein a single edge strip is allocated in each case a single fin.

23. The cellular wheel according to claim 22, wherein the recesses have a dimension of 1 to 2 mm.

24. The cellular wheel according to claim 20, wherein the inner sleeve is located on a flange sleeve that is arranged coaxially to said inner sleeve and is joined with the drive shaft, and the outer sleeve has notches extending, between adjacent fins, from both end faces of the cellular wheel, wherein a marginal edge of the outer sealing sleeves, which marginal edge is located remote from the end faces of the cellular wheel, protrudes the notches by an amount, and the outer sealing sleeves are joined with the outer sleeve only in the region protruding the notches.

25. The cellular wheel according to claim 24, wherein the inner sleeve has notches extending, between adjacent fins, from both end faces of the cellular wheel, and the inner sleeve is joined with the flange sleeve between adjacent fins between notches located opposite to each other.

26. The cellular wheel according to claim 20, wherein the sealing profile of the outer sealing sleeves has a sealing surface that is aligned with the end faces of the cellular wheel, and the outer sealing sleeves form with the outer sleeve an annular gap that is open at the end faces of the cellular wheel.

27. The cellular wheel according to claim 20, wherein the inner sleeve is joined with the drive shaft, and the intermediate sleeve(s) has (have) notches extending, between adjacent fins, from both end faces of the cellular wheel.

28. The cellular wheel according to claim 20, wherein the sealing profile of the outer sealing sleeves has a sealing surface that is aligned with the end faces of the cellular wheel, and in the inner sleeve, inner sealing sleeves joined with the inner sleeve are arranged, which inner sealing sleeves have a sealing profile with a sealing surface that is aligned with the end faces of the cellular wheel for forming a labyrinth seal.

29. The cellular wheel according to claim 28, wherein the outer and inner sealing sleeves are joined with the outer and inner sleeves, respectively, only in a region of an end located remote from the end faces of the cellular wheel, and form with the outer and inner sleeves, respectively, an annular gap that is open at the end faces of the cellular wheel.

30. The cellular wheel according to 29, wherein a volume of the annular gap is increased by a wall thickness of the outer and inner sealing sleeves that is reduced in the region of the annular gap; or wherein a volume of the annular gap is increased by a wall thickness of the outer and inner sleeves respectively, that is reduced in the region of the annular gap.

31. The cellular wheel according to claim 29, wherein for stabilizing the annular gap, spacer elements that are arranged distributed over the circumference of the outer and inner sealing sleeves protrude in the region of the end faces of the cellular wheel from that side of the outer and inner sealing sleeves that faces toward the outer and inner sleeves, respectively.

32. The cellular wheel according to claim 29, wherein for stabilizing the annular gap, spacer elements that are arranged distributed over the circumference of the outer and inner sleeves, respectively, protrude in the region of the end faces of the cellular wheel from that side of the outer and inner sleeves, respectively, that faces toward the outer and inner sealing sleeves.

33. The cellular wheel according to claim 20, wherein the length of the notches is 10% to 30% of the length of the cellular wheel; and/or wherein the outer sleeve, the inner sleeve, the intermediate sleeve(s), the fins and the sealing sleeves are made from sheet metal having a thickness of less than 0.5 mm.

34. The cellular wheel according to claim 20, wherein the drive shaft has two annular webs which are arranged coaxial to the drive shaft and spaced apart from one another and which have a circumferential surface as support surfaces for the inner sleeve, and at least one of the annular webs is joined with the inner sleeve.

35. The cellular wheel according to claim 34, wherein an end of inner sealing sleeves, which end is located remote from the end faces of the cellular wheel, is joined with an annular web, and/or wherein an inner sealing sleeve at an end face of the cellular wheel is joined with a cover, and/or wherein an annular web is joined with a cover.

36. The cellular wheel according to claim 20, wherein the drive shaft is configured as a hollow shaft having a tubular end part, a conical intermediate part and a tubular shaft part with a receptacle for a coupling piece to be connected to a motor drive.

37. The cellular wheel according to claim 36, wherein the tubular end part and the conical intermediate part have openings that are arranged symmetrically over the circumference, and/or wherein the coupling piece has a coupling axle with longitudinal ribs which, when sliding the coupling piece into the receptacle of the tubular shaft part, engage in longitudinal grooves in the receptacle.

38. A use of a cellular wheel according to claim 20, in a pressure wave supercharger for supercharging internal combustion engines, in particular of or Otto engines.

* * * * *